US006200091B1

(12) United States Patent
Bromann et al.

(10) Patent No.: US 6,200,091 B1
(45) Date of Patent: Mar. 13, 2001

(54) HIGH-PRESSURE TURBINE STATOR RING FOR A TURBINE ENGINE

(75) Inventors: Alain Marc Lucien Bromann, Savigny le Temple; Léopold Jean Marie de Verduzan, Les Ecrennes; Daniel Jean Marey, Soisy S/Seine, all of (FR)

(73) Assignee: Societe Nationale d'Etude et de Construction de Moteurs d'Aviation "Snecma", Paris (FR)

( * ) Notice: Subject to any disclaimer, the term of this patent is extended or adjusted under 35 U.S.C. 154(b) by 0 days.

(21) Appl. No.: 09/330,063

(22) Filed: Jun. 11, 1999

(30) Foreign Application Priority Data

Jun. 25, 1998 (FR) ..... 98.08053

(51) Int. Cl.[7] ..... F01D 11/08
(52) U.S. Cl. ..... 415/173.1
(58) Field of Search ..... 415/173.1, 115, 415/116, 136, 138, 173.2, 173.3, 175, 176, 177, 178

(56) References Cited

U.S. PATENT DOCUMENTS

| | | | | |
|---|---|---|---|---|
| 3,583,824 | | 6/1971 | Smuland et al. . | |
| 3,966,354 | | 6/1976 | Patterson . | |
| 4,023,731 | | 5/1977 | Patterson . | |
| 5,197,853 | * | 3/1993 | Creevy et al. | 415/173.1 |
| 5,205,708 | * | 4/1993 | Plemmons et al. | 415/173.1 |
| 5,288,206 | | 2/1994 | Bromann et al. . | |
| 5,399,066 | * | 3/1995 | Ritchie et al. | 415/176 |
| 5,593,276 | | 1/1997 | Proctor et al. . | |
| 5,593,277 | | 1/1997 | Proctor et al. . | |
| 5,915,919 | * | 6/1999 | Taillant et al. | 415/115 |
| 5,964,575 | * | 10/1999 | Marey | 415/115 |

FOREIGN PATENT DOCUMENTS 0 555 082 8/1993 (EP) .

* cited by examiner

*Primary Examiner*—Edward K. Look
*Assistant Examiner*—James M McAleenan
(74) *Attorney, Agent, or Firm*—Oblon, Spivak, McClelland, Maier & Neustadt, P.C.

(57) ABSTRACT

The present invention relates to the high-pressure turbine stator ring of a turbo engine that is fastened to the stator by tightening means that limit leaks to a minimum.

These means mainly comprise a tightening grip (40) that grips the curved section of a downstream leg (35V) of each spacer section (30) that is fastened to the turbine casing (1) of the stator by a curved downstream flange (23V) of each ring section (20).

Application to the fastening of the high-pressure turbine stator ring of a turbo engine.

3 Claims, 4 Drawing Sheets

HIGH-PRESSURE TURBINE STATOR RING FOR A TURBINE ENGINE

BACKGROUND OF THE INVENTION

1. Field of the Invention

The present invention relates to the stator of the high-pressure turbine in a turbine engine. It particularly relates to the sections of the stator that are opposite the rotor blades on the first stage of the high-pressure turbine.

2. Description of the Related Art

Referring to FIG. 1, in a number of examples of turbine engines the turbine casing 1 of the stator comprises annular sections 2 that are positioned opposite blades 3 of rotor 4 at the entrance to the high-pressure turbine downstream of combustion chamber 5. Therefore, these annular sections 2 of the turbine casing 1 create play with the top of blades 3 of stator thereby determining the efficiency of the turbine engine.

However, these annular sections 2 are supplied with gas at temperatures that enable them either to dilate or to contract in order to reduce the play that exists between these blades 3 and these annular sections 2 to an absolute minimum and thereby increase the efficiency of the turbine engine. The gas is generally drawn from another area of the turbine engine according to the temperature of the gas or the speed of the rotor.

Referring to FIG. 2, the annular section of the stator comprises an inner ring that can be in a single piece but that often comprises a series of ring sections 6 that face the end of blades 3 of the rotor. They are supported by a spacer section 10 that is fastened to the turbine casing 1 and in which at least one cavity 11 is provided and that is in contact with ring sections 6 in order for thermal adjustment to be made to said ring sections. These ring sections 6 are fastened to spacer sections 10 of the stator using grips 7 that are positioned on the respective downstream flanges 8 and 9 of ring sections 6 and spacer sections 10, these two flanges 8 and 9 abutting. The upstream fastening is achieved by an upstream flange 12 of each spacer section 10 being inserted into an upstream groove 13 of each ring section 6.

It should be noted that this type of high-pressure turbine engine can comprise several stages of this kind and several subsequent ring section and spacer section stages. The ring sections 6 are located at the entrance to the high-pressure turbine in a zone where the temperature can reach 1,500° C. Consequently, the ring sections must be cooled. Also, the leaktightness between these ring sections 6 and spacer sections 10 must be as tight as possible in order to avoid any loss of the air flow from the turbine engine. The fastening grips 7 partly enable this leaktightness to be achieved. However, given the dilation due to differences in temperatures during operation, air leaks occur and the amount of air flow required from the engine to cool ring sections 6 can be significant.

The aim of the invention is to overcome this drawback by minimizing the leaks and the air flow taken from the engine in order to maintain a high level of efficiency from the turbine engine.

SUMMARY OF THE INVENTION

In order for this to be achieved, the main object of the invention is a high-pressure turbine stator ring for a turbine engine comprising turbine casing, the ring comprising the following:

spacer sections in the arc of a circle that constitute a ring-shaped spacer closed at a 360° angle, fastened to the inner surface of the turbine casing and that include an upstream leg and a downstream leg; and ring sections in the arc of a circle that constitute a ring-shaped spacer closed at a 360° angle to be opposite, on their inner surface, to the envelope that is constituted by the blade ends of the rotating high-pressure turbine, said ring sections are fastened to the downstream leg of the spacer sections by a downstream flange that is fastened to the downstream leg of the spacer sections by fastening grips that grip both kinds of sections against each other at their downstream leg and downstream flange.

According to the invention, the downstream leg of the spacer sections and the downstream flange of the ring sections are curved and abut at radial junction surfaces that respectively extend the outer surface of the downstream leg of the spacer sections and the inner surface of the fastening flange of the downstream leg of the ring sections. This enables a 90° radial edge to be created that constitutes an additional operational part in terms of leaktightness. Furthermore, the fastening grips are positioned around the downstream section of the assembly that is thus created by the curved downstream leg and flange of the spacer sections and the ring sections.

In the main embodiment the ring sections comprise an upstream flange that is intended to be inserted in a corresponding groove of an upstream leg of the spacer sections in order to fasten the ring sections onto the spacer sections on the upstream side.

In a first utilization of the tightening grips the tightening surfaces bear on a curved section of the outer surface of the downstream leg of the spacer sections and on the curved section of the outer surface of the downstream flanges of the ring sections.

In a second utilization of the tightening grips the tightening surfaces bear on a curved section of the outer surface of the downstream leg of the spacer sections and on the curved section and the non-curved section of the outer surface of the downstream flanges of the ring sections.

BRIEF DESCRIPTION OF THE DRAWINGS

The invention and its various technical characteristics will be better understood from the following detailed description of an embodiment of the invention. The description has a number of attached figures where.

DETAILED DESCRIPTION OF THE PREFERRED EMBODIMENTS

Figure 1:
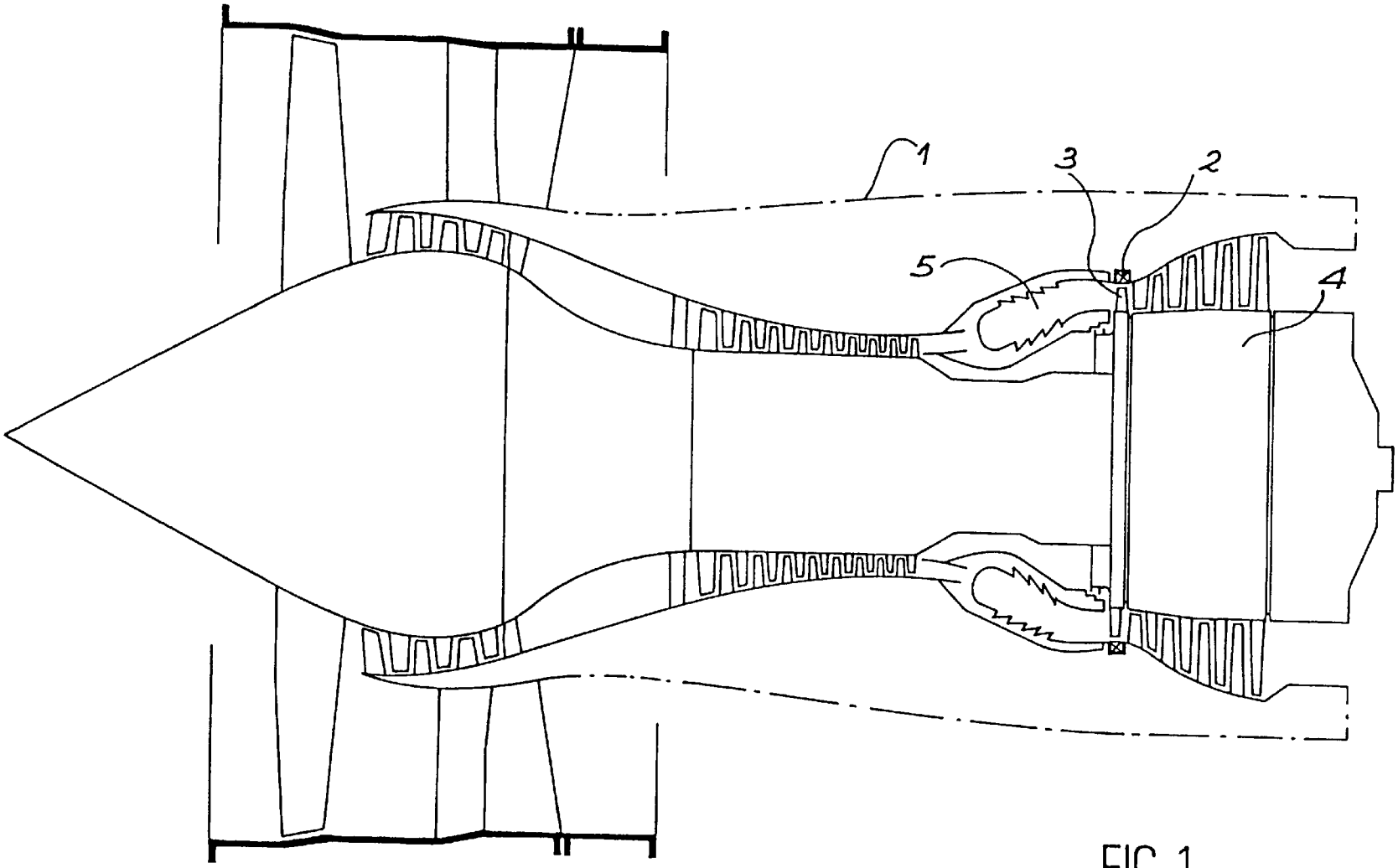
FIG. 1 BACKGROUND ART
FIG. 1 is a cross section of a turbine engine in which the invention may be used.
Figure 2:
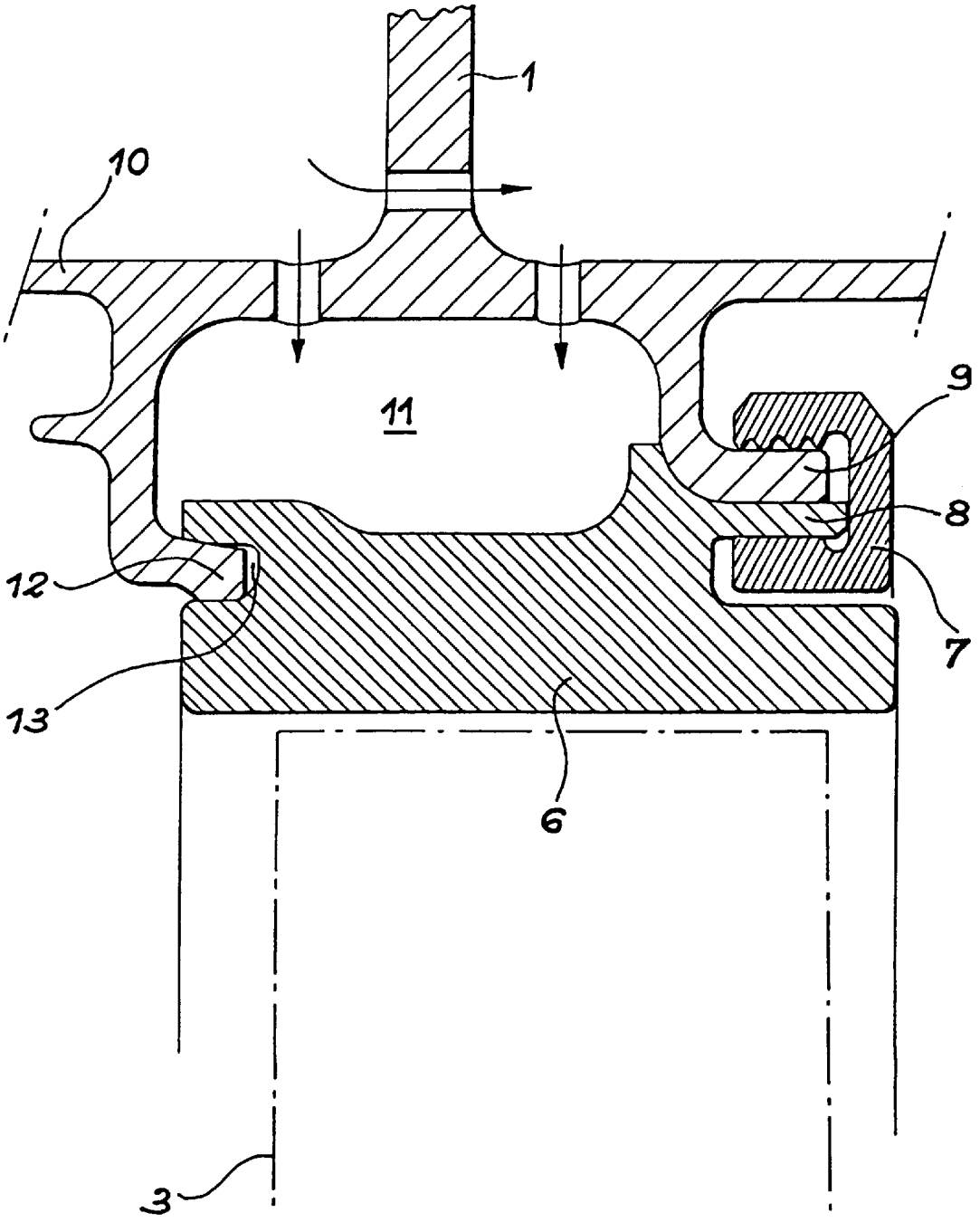
FIG. 2 BACKGROUND ART
FIG. 2 is a cross section of a high-pressure turbine stator ring of the prior art.
Figure 3:
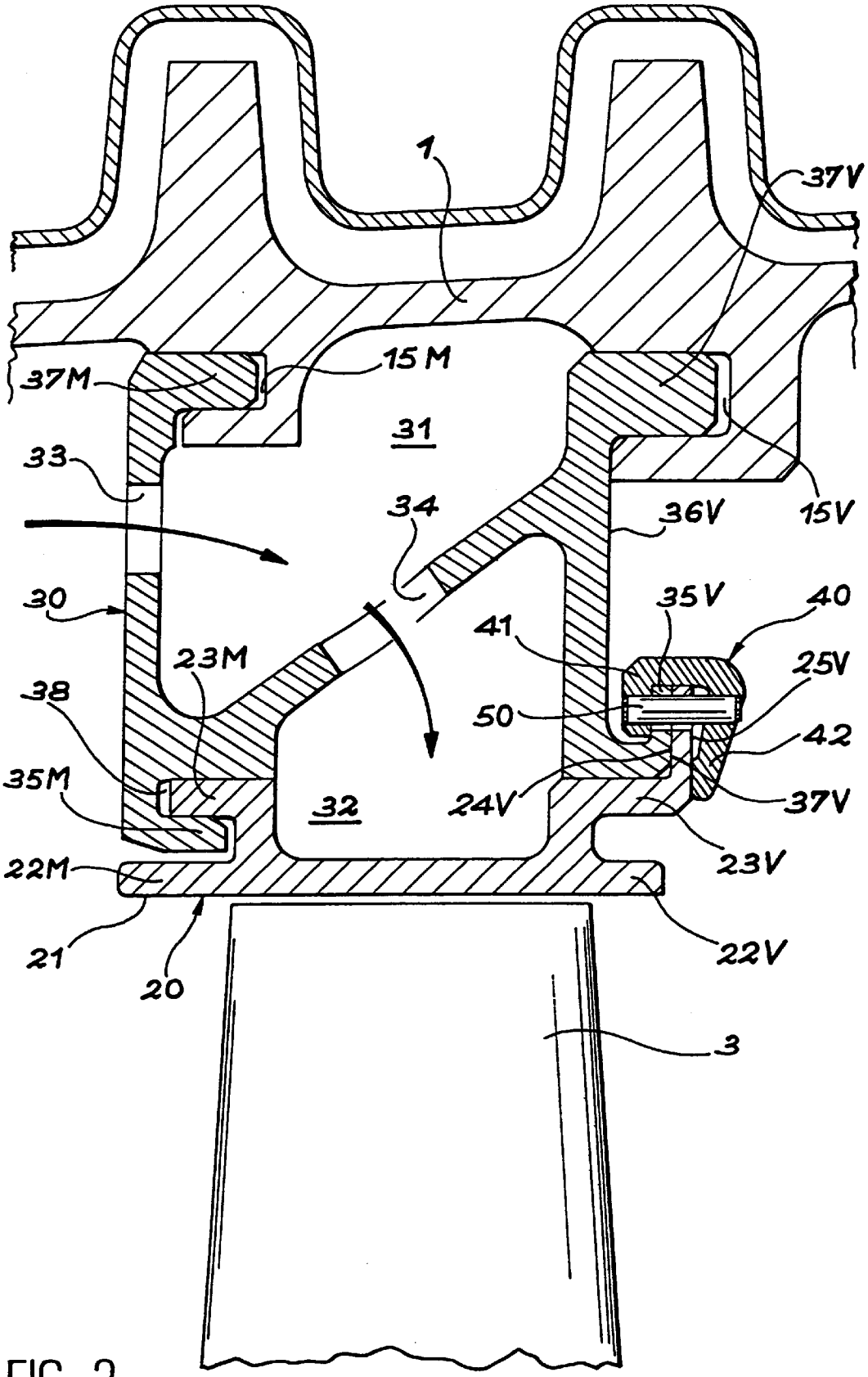
FIG. 3 is a cross section of a high-pressure turbine stator ring according to the invention in a first embodiment.
Figure 4:
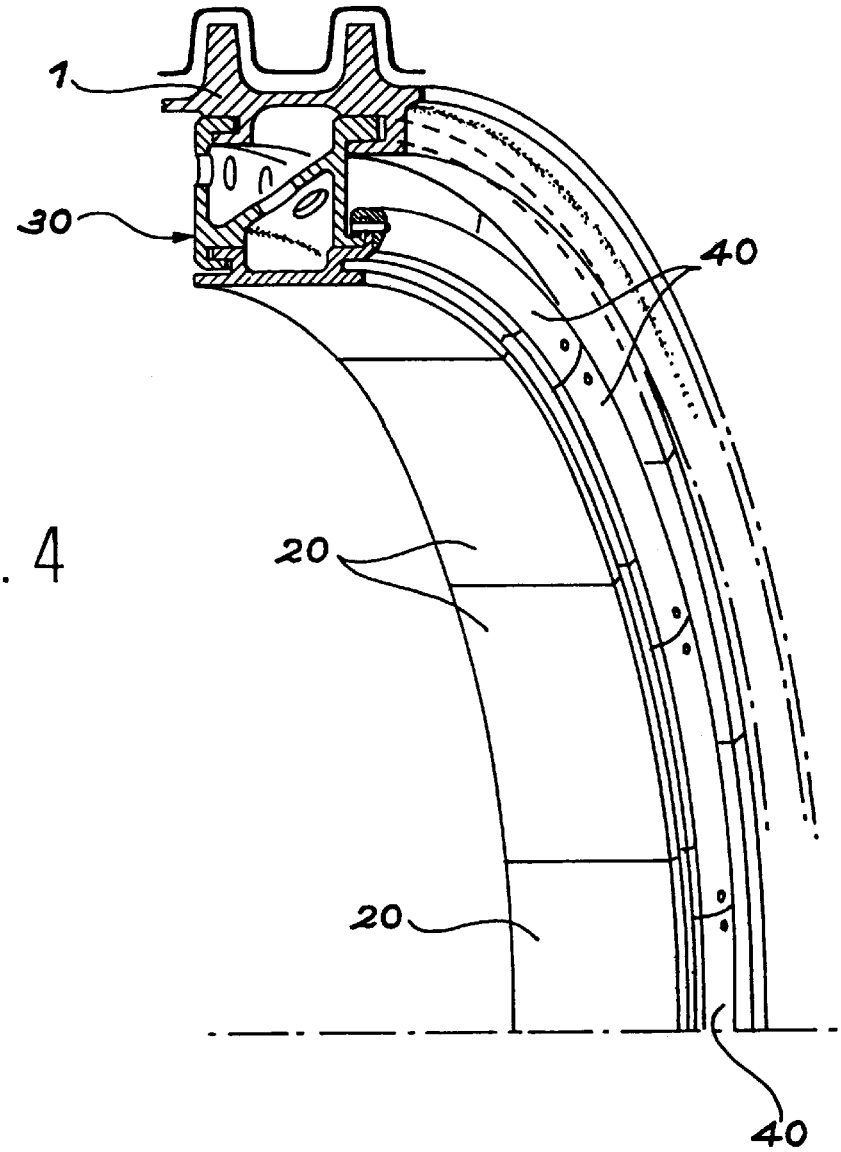
FIG. 4 is an overhead view in partial cross section of the high-pressure turbine stator ring according to the invention in FIG. 3.

FIG. 3 is a detailed drawing of the first embodiment of the high-pressure turbine stator ring according to the invention. FIG. 3 shows the end of a blade 3 of the rotor that rotates opposite inner surface 21 of a ring section 20 that is fastened to the stator by the turbine casing 1. This fastening is achieved by spacer sections 30 that are, themselves, each fastened to the turbine casing 1. The spacer sections 30 constitute a fixed fastening ring, as in the embodiment of the prior art described in FIG. 2. Moreover, FIG. 4 clearly shows this ring of spacer sections 30 that is fastened to the turbine casing 1. There is a relatively large number of sections. This ring of spacer sections 30 constitutes a ring-shaped channel that enables gas drawn from another section of the turbine engine to come into contact with ring sections 20 and to affect their temperature.

Referring again to FIG. 3, this gas flow may be seen to penetrate into the spacer sections through a first aperture 33 in order to penetrate into a first cavity 31 and into a second cavity 32 through a second aperture 34. Therefore, the gas flow drawn upstream in the turbine engine can be in direct contact with ring sections 20 and affect their temperature.

This spacer section 30 is fastened to the turbine casing 1 by an upstream fastening head 37M that is inserted in annular grooves 15M and by a downstream fastening head 37V that is inserted in a downstream groove 15V of the turbine casing 1.

The upstream side 22M of each ring section 20 is fastened in relation to spacer section 30 by an upstream flange 23M that is inserted in an annular groove 38 of upstream leg 35M of each spacer section 30.

The downstream side of the ring sections is fastened by a downstream flange 23V of each ring section 20 whose inner downstream surface 24V abuts on the outer downstream surface 37V of downstream leg 35V of each spacer section 30. One major characteristic of fastening according to the invention is that these two surfaces that are abutted are curved upwards, i.e. towards the outside of the rotation axis of the turbine engine. In the embodiment described in FIG. 3 these two surfaces are perpendicular to this axis, i.e. they constitute radial junction surfaces. These two radial junction surfaces are held bonded together or abutted in this position using several fastening grips 40 positioned around all the circumference of the assembly. A first gripping foot 41 is inserted in the recess provided in the outer downstream surface 36V of each spacer section 30, while a second gripping foot 42 abuts on outer downstream surface 25V of downstream flange 23V. In other words, the inner downstream surface 24V of each ring section 20 extends such that it curves perpendicular to the axis of the turbine engine. This also applies to outer downstream surface 37V of downstream leg 35V, the end of the downstream leg of each spacer section 30 and the downstream flange 23V of each ring section 20 being of reduced thickness.

As shown in FIG. 3, tightening grips 40 are preferably held in the gripping position using a positioning pin 50. Said positioning pin crosses both gripping feet 41 and 42 and the curved sections of downstream leg 35V of each spacer section 30 and of downstream flange 23V of each ring section 20. This enables centrifugal force to be resisted that ejects fastening grips 40 towards the outside, i.e. towards the turbine casing 1.

Figure 5:
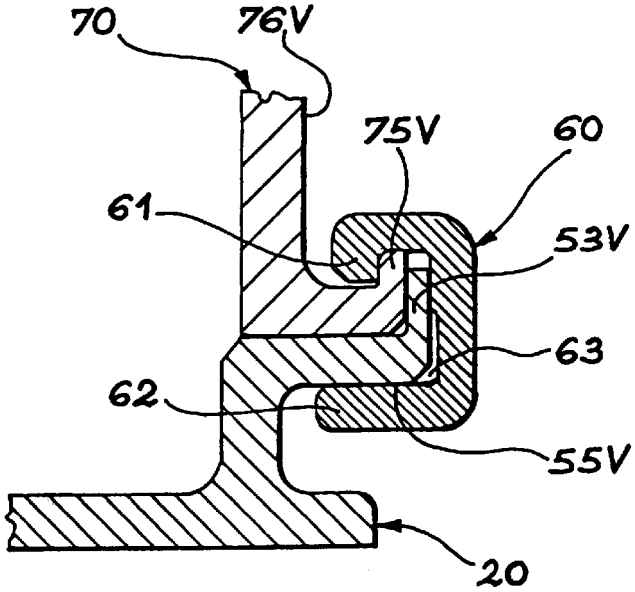
FIG. 5 is a partial cross section of a detail of a high-pressure turbine stator ring in a second embodiment according to the invention.

Referring to FIG. 5, a second embodiment of fastening downstream leg 75V of spacer sections 70 and ring sections 20 can be achieved using a second kind of fastening grip 60.

As shown in the embodiment in FIG. 3, this fastening grip 60 can have a first gripping foot 61 that comes to bear on outer downstream surface 76V of spacer section 70. On the other hand, the second gripping foot 62 comes to bear on outer downstream surface 55V of downstream flange 53V in a position where this downstream surface 55V is coaxial with the axis of the turbo engine. In other words, fastening grip 60 comes to bear on downstream flange 53V with second grip 62 before the curved section of said downstream flange. A recess 63 inside grip 60, positioned opposite the curved section of this downstream flange 53V, enables fastening grip 60 to have better gripping on the assembly, particularly on the downstream leg of each ring section 20.

A large number of tightening grips are therefore used around the entire periphery of the assembly between the ring sections 20 and spacer sections 70.

The main advantage of the invention is to achieve the highest level of leaktightness possible around this high-pressure turbine ring in the aim of reducing the air flow that is drawn from the turbo engine in order to cool the ring sections and thereby maintaining a high level of efficiency from this turbo engine.

What is claimed is:

1. High-pressure turbine stator ring for a turbo engine, the stator comprising a turbine casing that, per stage, comprises the following:

spacer sections in the arc of a circle that constitute a ring-shaped spacer closed at a 360° angle and that is fastened to the inner surface of the turbine casing and that has an upstream leg and a downstream leg; and ring sections in the arc of a circle closed at a 360° angle to be opposite, on their inner surface, to the envelope that is constituted by the blade ends of the turbine wheels, said ring sections being fastened to the downstream leg of the spacer sections by a downstream flange that is fastened to the downstream leg of the spacer sections by fastening grips that grip both kinds of sections against each other at their downstream leg and the downstream flange, the end of the downstream leg of each spacer section and the downstream flange of each ring section being of reduced thickness, characterized in that the downstream leg of the spacer sections and the downstream flanges of the ring sections are curved and abut at radial junction surfaces that extend the outer surface of the downstream leg of the spacer sections and the inner surface of the downstream flange of the ring sections thereby creating a 90° radial edge that constitutes an additional operational part in terms of leaktightness, the fastening grips being positioned around the downstream section of the assembly that is thus created by the curved downstream leg and the downstream flange of the spacer sections and the ring sections, the gripping surfaces of the fastening grips bearing on the curved section of outer surface of the downstream leg of the spacer sections and on the curved section and the non-curved section of the outer surface of the downstream flange of the ring sections.

2. Stator ring of claim 1 in which the upstream flange of the ring sections is intended to be inserted in a corresponding groove of an upstream leg of the spacer sections.

3. Stator ring of claim 1 characterized in that the gripping surfaces of the fastening grips bear on a curved section of outer surface of the downstream leg of the spacer sections and on the curved section of the outer surface of the downstream flanges of the ring sections.

* * * * *